US007963326B2

(12) United States Patent
Giacomino

(10) Patent No.: US 7,963,326 B2
(45) Date of Patent: Jun. 21, 2011

(54) METHOD AND APPARATUS FOR UTILIZING PRESSURE SIGNATURE IN CONJUNCTION WITH FALL TIME AS INDICATOR IN OIL AND GAS WELLS

(75) Inventor: Jeffrey L. Giacomino, Brighton, CO (US)

(73) Assignee: Production Control Services, Inc., Frederick, CO (US)

( * ) Notice: Subject to any disclaimer, the term of this patent is extended or adjusted under 35 U.S.C. 154(b) by 499 days.

(21) Appl. No.: 11/959,364

(22) Filed: Dec. 18, 2007

(65) Prior Publication Data

US 2008/0164024 A1 Jul. 10, 2008

Related U.S. Application Data

(60) Provisional application No. 60/870,569, filed on Dec. 18, 2006.

(51) Int. Cl.
*E21B 43/16* (2006.01)

(52) U.S. Cl. ..... 166/250.15; 166/68

(58) Field of Classification Search ..... 166/254.1, 166/250.01, 250.15, 54, 68, 107; 137/487, 137/624.2

See application file for complete search history.

(56) References Cited

U.S. PATENT DOCUMENTS

| | | | | |
|---|---|---|---|---|
| 3,863,714 | A | 2/1975 | Watson, Jr. | |
| 4,961,441 | A | 10/1990 | Salter | |
| 4,989,671 | A | 2/1991 | Lamp | |
| 5,314,016 | A | 5/1994 | Dunham | |
| 5,526,883 | A | 6/1996 | Breaux | |
| 5,636,693 | A | 6/1997 | Elmer | |
| 5,785,123 | A | 7/1998 | Lea, Jr. | |
| 5,826,659 | A | 10/1998 | Hershberger | |
| 5,878,817 | A | 3/1999 | Stastka | |
| 5,957,200 | A | 9/1999 | Majek et al. | |
| 5,984,013 | A | 11/1999 | Giacomino et al. | |
| 6,196,324 | B1 | 3/2001 | Giacomino et al. | |
| 6,241,014 | B1 | 6/2001 | Majek et al. | |
| 6,464,011 | B2 | 10/2002 | Tubel | |
| 6,595,287 | B2 * | 7/2003 | Fisher | 166/250.15 |
| 6,634,426 | B2 | 10/2003 | McCoy et al. | |
| 6,705,404 | B2 | 3/2004 | Bosley | |
| 6,719,060 | B1 | 4/2004 | Wells | |
| 6,830,108 | B2 | 12/2004 | Rogers, Jr. | |
| 6,883,606 | B2 | 4/2005 | Evans et al. | |
| 6,907,926 | B2 | 6/2005 | Bosley | |
| 6,966,366 | B2 | 11/2005 | Rogers, Jr. | |
| 7,004,258 | B2 | 2/2006 | Farris | |
| 7,040,401 | B1 | 5/2006 | McCannon | |
| 7,099,780 | B2 | 8/2006 | Faur et al. | |
| 7,219,725 | B2 * | 5/2007 | Chisholm | 166/68 |
| 2005/0178543 | A1 | 8/2005 | Giacomino | |
| 2008/0110617 | A1 | 5/2008 | Giacomino | |
| 2009/0200020 | A1 * | 8/2009 | Hearn | 166/250.01 |

FOREIGN PATENT DOCUMENTS

WO WO 02/29197 A2 4/2002

* cited by examiner

*Primary Examiner* — Daniel P Stephenson

(74) *Attorney, Agent, or Firm* — A Law Firm, P.C.; Aileen Law

(57) ABSTRACT

Disclosed is a method of utilizing a pressure signature in conjunction with a plunger's fall time as an indicator of plunger location. The disclosed method can also indicate well and/or plunger conditions. A controller that can see and interpret slope change and/or pressure signature and automatically make changes to plunger fall time is also disclosed.

24 Claims, 20 Drawing Sheets

METHOD AND APPARATUS FOR UTILIZING PRESSURE SIGNATURE IN CONJUNCTION WITH FALL TIME AS INDICATOR IN OIL AND GAS WELLS

CROSS REFERENCE APPLICATIONS

This application is a non-provisional application claiming the benefits of provisional application No. 60/870,569 filed Dec. 18, 2006.

TECHNICAL FIELD OF ART

The disclosed method and apparatus relate generally to removing liquids from a wellbore by means of a plunger lift system, and more specifically to the determination of a fall time indicating when a plunger is at well bottom for well control and optimization.

BACKGROUND

Oil and natural gas are often found together in the same reservoir. The composition of the raw natural gas extracted from producing wells depends on the type, depth, and location of the underground deposit and the geology of the area. During production, oil, gas, and water flow to the surface, passing as an emulsion or a mixture.

During a well's flowing life, liquids tend to migrate down the tubing and start to collect at a well bottom, causing a gradual increase in back pressure. Fluid buildup may cause the lifting efficiency of a well to decrease and in some cases, may even cause a well to cease to flow.

Operators may use any number of artificial lift techniques to raise fluid to the surface after a well slows or ceases to flow. One known method comprises plunger lift. The function of the plunger is to prevent fluid buildup from accumulating to the point that the well would cease to flow. In addition, a plunger can minimize a lengthy "shut in" time during which a well is enabled to recover.

The operation of a plunger lift system relies on the natural buildup of pressure in a well during the time that the well is shut in at the surface by a wellhead controller (or in an "off" mode). When a well is shut in, casing pressure is allowed to build up. In a shut in mode, no production occurs. When the casing pressure has sufficiently built up to enable the accumulated liquids in the tubing to be lifted along with the plunger, the well is opened up. A plunger lift system operates to "lift" oil or water and natural gas from a well bottom during natural gas production when the well is in an "on" mode, thus unloading fluid buildup and increasing the productivity of oil and natural gas wells. Functionally, the plunger provides a mechanical interface between the produced liquids and the gas. This mechanical interface eliminates liquid fallback which thereby boosts a well's lifting efficiency.

In the industry, the optimization of plunger lift has primarily focused on changing the on/off cycle time based on factors such as time, differential pressure, plunger arrival speeds, etc. In fact, most plunger lift controllers commonly pre-set a minimum off time or fall time on the premise that this minimum time will allow the plunger to fall safely to the bottom of the well before the on time cycle is enabled. With the disclosed method, fall time can be optimized to provide more effective well control functions.

It is well-known in the industry that the science of determining fall time can be imprecise. In general, operators often determine that the plunger is on bottom based on an arbitrary interval of time, a guess. For example, an operator can assume it takes a plunger 45 minutes to travel to well bottom. This travel time is typically referred to as "fall time," which can be the actual or estimated interval of time when a motor valve is shut to close the flowline and when the plunger hits bottom. Many factors, however, can affect the actual fall time of a plunger. Different types and brands of plungers fall at different rates. For example, a 2⅜" pad-type plunger can have a fall time of about 48 minutes. In the same well, a bar-stock plunger can fall in about 22 minutes; a by-pass plunger can reach bottom in about seven minutes. In addition, new plungers have been observed to fall at different rates than worn plungers. Therefore, a worn bar-stock plunger can take considerably less time reaching bottom than a new bar-stock plunger with a fall time of 22 minutes.

Fall time can also be a function of a well's depth and the amount and composition of liquid in the well. Well maturity can also alter plunger fall times. As a well matures, it can produce more or less fluid or gas through which a plunger falls. In addition, the presence of salt, sand, or solids can have an influence on how quickly the plunger reaches bottom. Well bore features can also affect fall time. Such features can include but are not limited to the condition of the tubing, whether the tubing is rough or smooth, the type of rod-cuts, the existence of tight spots, scale, and/or paraffin build up. Other conditions affecting plunger fall time would be known to those skilled in the art.

U.S. Pat. No. 6,634,426 to McCoy et al. teaches the tracking of plunger position by monitoring acoustic signals generated by an echometer as the plunger falls down the tubing. Plunger arrival on the bottom is shown in FIG. 12, for example. Plunger arrival on the bottom is also charted using data from tubing pressure and casing pressure signals. See also FIG. 12. McCoy et al., however, do not provide an operator and/or a well controller with the ability to manually and/or automatically adjust a plunger's fall time.

To maximize a plunger's function, the well should be opened up when the plunger is on well bottom. In some cases, the plunger may not actually be located on bottom when a flowline is opened. Here, the well operator may not discover that the plunger did not lift its load potential because some fluid is actually seen at the surface. The fluid carried may only reflect a portion of the liquid load potential. The act of leaving liquid downhole is inefficient because the well will remain "loaded up" and will only flow for a short time before it will need to be shut in to recover. In other cases, the plunger may be on bottom for a longer period of time than necessary. In the example above where an operator estimates a fall time of 45 minutes, a plunger could actually be on bottom in 25 minutes, causing a well to be potentially shut in for 20 minutes longer than necessary. Using the correct fall time, the well could be flowing 20 minutes longer per cycle. For example, with 20 cycles per day, an additional 20 minutes of flow time would result in about 400 minutes of flow time per well that was not being realized. In a field having multiple plunger lift wells, the potential sales realized could be significant. Therefore, it can be a useful objective for an operator and/or well controller to use various well parameters, including that of a pressure signature or slope change, to help indicate when a plunger is on bottom to optimize the time when the well may be opened up.

Typically, pressure transducers mounted to the casing and the tubing can provide data that correlate with pressure differentials that can signal a controller when a well is ready to turn on or turn off. In the industry, however, pressure data has not been used to track plunger fall time for well optimization. To detect a slope change, which indicates that a plunger has reached fluid or bottom, frequent samples may provide an accurate picture of what can be occurring downhole. For example, a device could sample as often as every second or faster to obtain downhole travel data. It is unlikely that common well controller systems that sample as often as every 4-30 minutes, can detect the details of a pressure signature or slope change. The disclosed system provides a well controller that can see and interpret pressure signature and/or slope change and allow manual and or automatic adjustments to plunger fall time.

SUMMARY OF THE DISCLOSURE

Operation of a plunger lift system can be initiated by shutting in the flowline and allowing formation gas to accumulate in the casing annulus through natural separation of gas from oil. After pressure builds up in the annulus to a certain value, the flowline is opened. As the well is opened and the tubing pressure is allowed to decrease, the stored casing gas rapidly moves around the end of the tubing and pushes the plunger to the surface along with the liquids in the tubing above it. Plunger lift can also be utilized with slim hole applications and in wells having a packer.

Upon arrival of the plunger at the surface, the tubing string should be completely free of liquids. At this point, a formation encounters low resistance to gas flow. Depending on the productivity of the well, this high flow rate may be sustained by leaving the flowline open for a time interval. The specific interval of time during which a flowline can be left open may be determined by measuring a certain pressure drop or rise on the casing or by observing the sales chart. The well should be shut in when fluid loading occurs, which can be evidenced by a decline or increase in a pressure differential, for example, that shown on the sales line, etc. As stated above, the time that a well is shut in is determined by reviewing pressure build up in the annulus or tubing and annulus differential. At a certain value, a flowline can be ready to be opened. However, a plunger should be located at the well bottom so it can carry an optimum amount of liquids to the surface. Also, if the well turns on before the plunger reaches bottom, it can "surface dry" or arrive at surface without liquid. Because plungers can achieve a velocity of about 4000 feet per minute or more, this can cause catastrophic failure to a well without the fluid load to slow the plunger's travel speed. In addition, plungers can break, get stuck in the tubing, etc. To avoid the possibility of these occurrences, a well operator will typically err on the side of caution and increase the pre-set minimum fall time for each cycle.

The present system can provide a method for using well data for controlling and operating hydrocarbon production wells. The disclosed system can allow an operator to easily review tubing and/or casing pressure data, correlate that data with knowledge that a plunger is on bottom to optimize a fall time, and open the flowline so a plunger may flow upward along with all of the liquids in the tubing. Fall times can be changed manually or automatically as the situation necessitates, e.g. every cycle, every 10 cycles, etc. Alternately, an average fall time may be used. The disclosed system optimizes the time a well is shut in thereby allowing casing pressure to build. By monitoring tubing and/or casing pressure, looking for a slope change of tubing and/or casing pressure that confirms that a plunger is on bottom, and adjusting fall times, the system can achieve a more precise well control methodology that can adapt to the ever-changing conditions of a well. Manual adjustments can be made to simple controllers. Alternately, a well control system can be fully automated. The disclosed system can minimize the instances where a plunger is not at bottom, or where a plunger is on bottom for too long, and can thus maximize production.

The graphical depictions of well data used herein are for illustrative purposes only. Although graphs are presented to explain the concept of the disclosed device, the present system need not utilize a graph to provide a method for using well data for controlling and operating hydrocarbon production wells. Tubing and/or casing pressure data can be monitored in any known manner. For example, the present system can be automated to interpret pressure data and/or detect pressure signatures without generating a graphical depiction. In addition, any of the pressure data may be manipulated for ease of the user and/or to base well productions decisions thereon. For example, one or more data points could be filtered, cross-sectioned, etc. if desired.

These and other features and advantages of the disclosed apparatus reside in the construction of parts and the combination thereof, the mode of operation and use, as will become more apparent from the following description, reference being made to the accompanying drawings that form a part of this specification wherein like reference characters designate corresponding parts in the several views. The embodiments and features thereof are described and illustrated in conjunction with systems, tools and methods which are meant to exemplify and to illustrate, not being limiting in scope.

Figure 1:
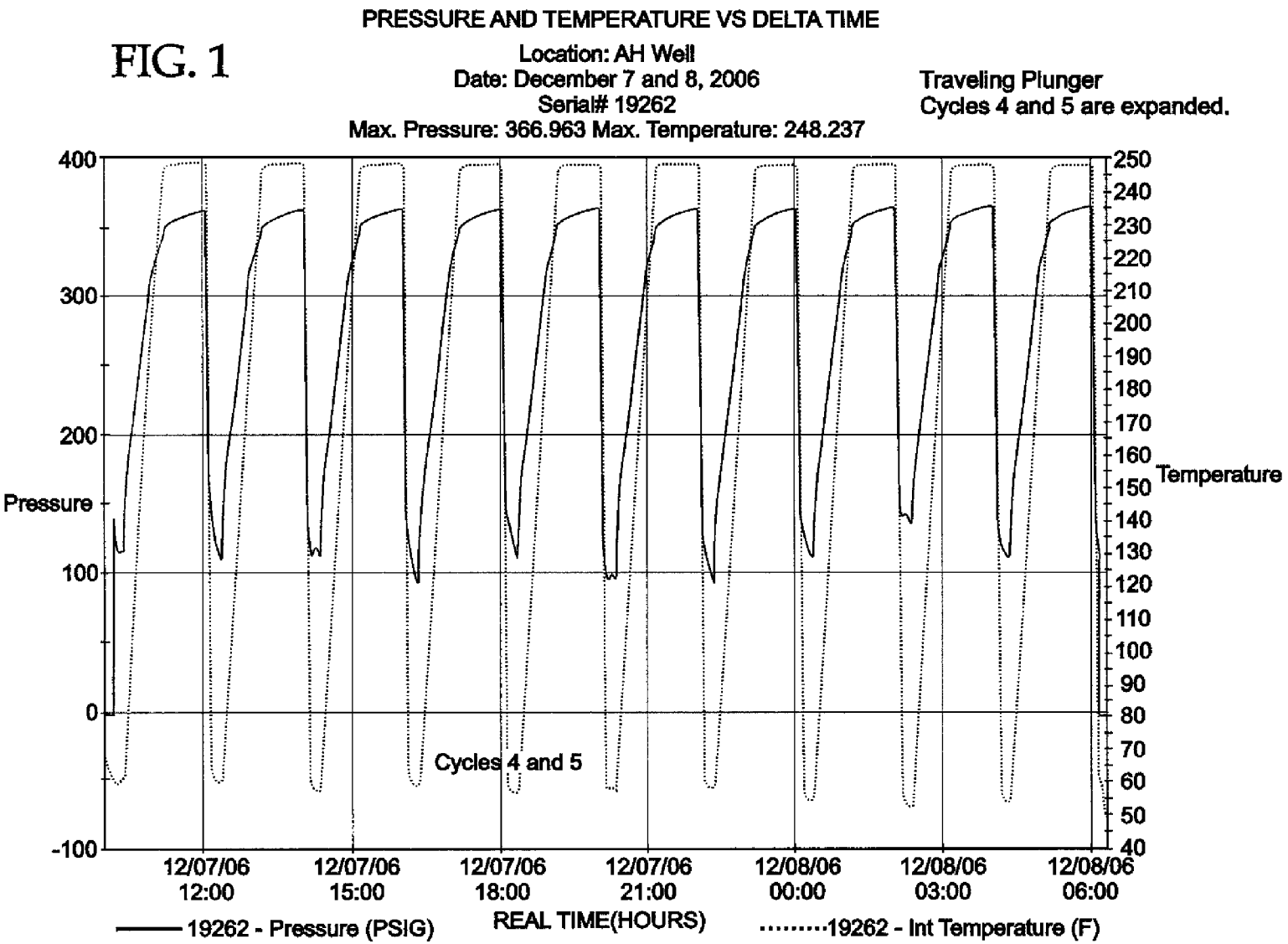
FIG. 1 is graphical depiction of pressure and temperature charted versus time for a typical well utilizing a plunger lift system, monitored over an 18-hour period of time. The graphical results were produced from data generated by means of a plunger lift system having a data logger computer housed therein to collect well parameter data at about a one-second sample rate.

Before explaining the disclosed embodiments in detail, it is to be understood that the embodiments are not limited in application to the details of the particular arrangements shown, since other embodiments are possible. Also, the terminology used herein is for the purpose of description and not of limitation.

DETAILED DESCRIPTION OF THE FIGURES

The disclosed system can provide an operator with a way to better determine the shut in time of a gas production well. As stated above, many production parameters are typically reviewed to determine whether a well is ready to be turned "on". Some operators review pressure differentials while others use a pre-set "on" and "off" time. With the disclosed system, an operator or well controller can optimize operations by confirming that a plunger is on bottom even if all other production parameters signal that a flowline should be opened. The disclosed system allows an operator or well controller to wait until the plunger is confirmed to be on bottom and/or to establish a fall time rate for a well, thus optimizing the "off" time of a well.

As stated above, the fall time can be the actual or estimated interval of time when a motor valve is shut (thereby closing the flowline) and when the plunger hits bottom. In the industry, operators often estimate that it takes a well-sealed plunger about 30 to about 40 minutes to fall to well bottom depending on depth. It is not uncommon that when a device such as that used to generate the data plotted in FIG. 1 has been implemented, operator based assumptions highly overestimate or underestimate the plunger's actual fall time. In one case, the data logger device was able to establish an actual real-time fall time that of about 25 minutes compared to the operator-based assumption of about 40 to about 50 minutes. A more reliable fall time can greatly reduce the risk of operator-based inefficiency.

With the frequency of sampling employed by the disclosed system, an operator or well controller can simply view or interpret a graph of tubing pressure and/or casing pressure, associate the pressure data with a fall time, analyze the pressure data for the occurrence of one or more slope changes, and control the well with an increased confidence level. Applicant has discovered that a well builds pressure on the tubing and the casing differently when the plunger is falling in gas, in fluid, or while on bottom. By sampling more frequently, slope changes for each phase or event can be more unambiguously documented. This slope change data was corroborated through the use of a data logger plunger. Pressure data can be filtered to facilitate the viewing of unambiguous slope changes. In addition, as discussed below, the slope on the tubing pressure curve is shown to increase while the slope on the casing pressure curve is shown to decrease. In an automated system, a well controller can extrapolate information from the pressure signature or slope change to cause an adjustment of plunger fall time.

The data logger device used to generate the data plotted in FIG. 1 can be used to provide real-time actual knowledge that a plunger is in fact on bottom. In some cases, an operator may need a system such as a data logger plunger with the capability of sampling every one second. Such a sampling rate could be categorized as a fast rate of sampling, however, samples could be taken up to about ten times a second if desired. In addition, other sampling rates could be used if suitable. For example, a sampling rate of about once per day, about once every 12 hours, about once every 32 minutes, about once every five seconds, etc. could be applied depending on circumstances deemed suitable by one having skill in the art.

The disclosed system can achieve a well control methodology that can adapt to the ever-changing conditions of a well. The disclosed system contemplates a controller and suitable programming that can detect slope changes and automatically adjust plunger fall time. The controller will typically look at the tubing and/or casing for a slope change or pressure signature when the well shuts in and the plunger is falling. A stand alone device and suitable programming can be used with a well(s) that have been implemented with other plunger lift systems.

Figure 11:
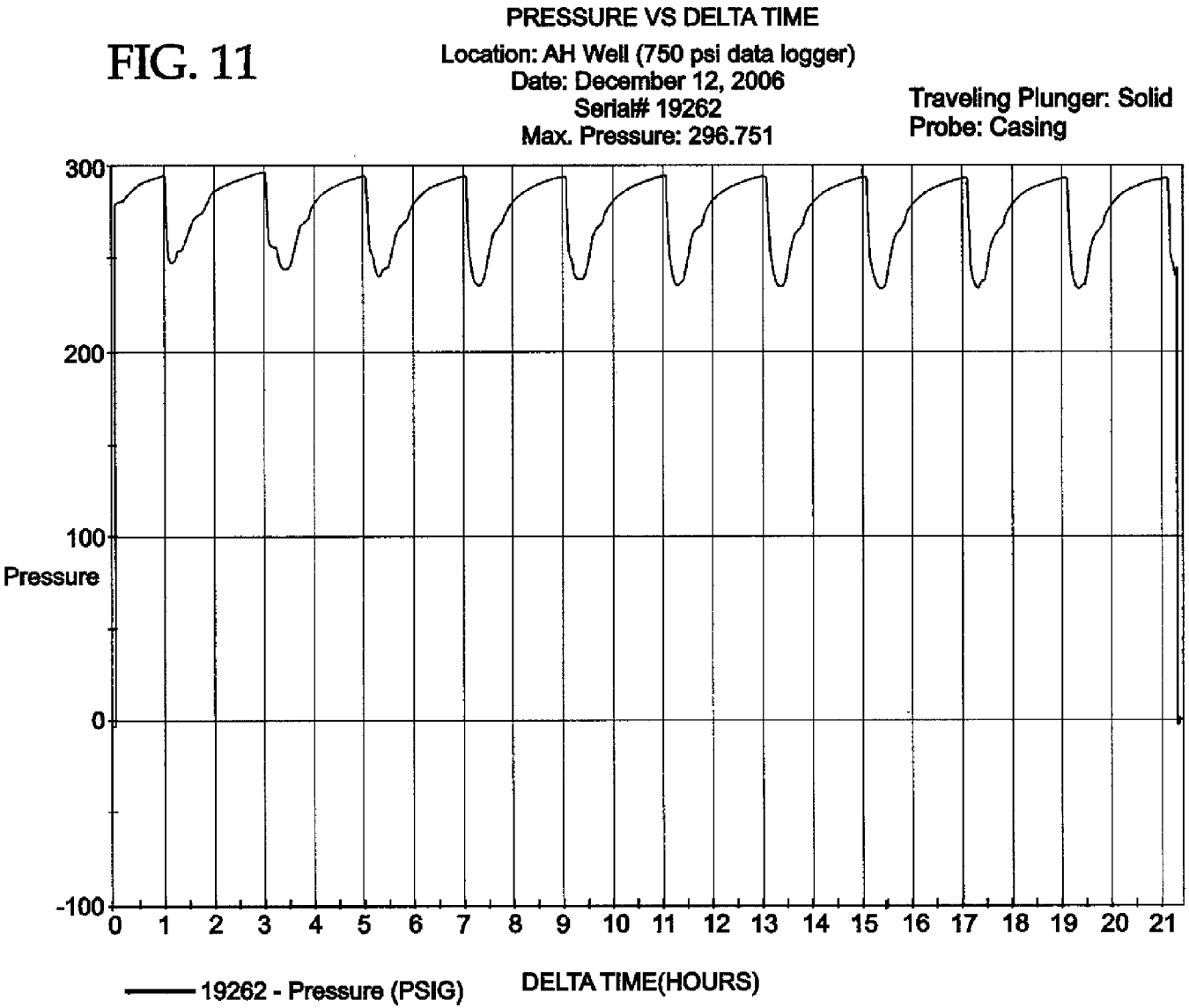
FIGS. 11-13 are graphical depictions of pressure charted versus time for a typical well utilizing a solid plunger in communication with a transducer mounted to a well's casing at the well surface.
Figure 12:
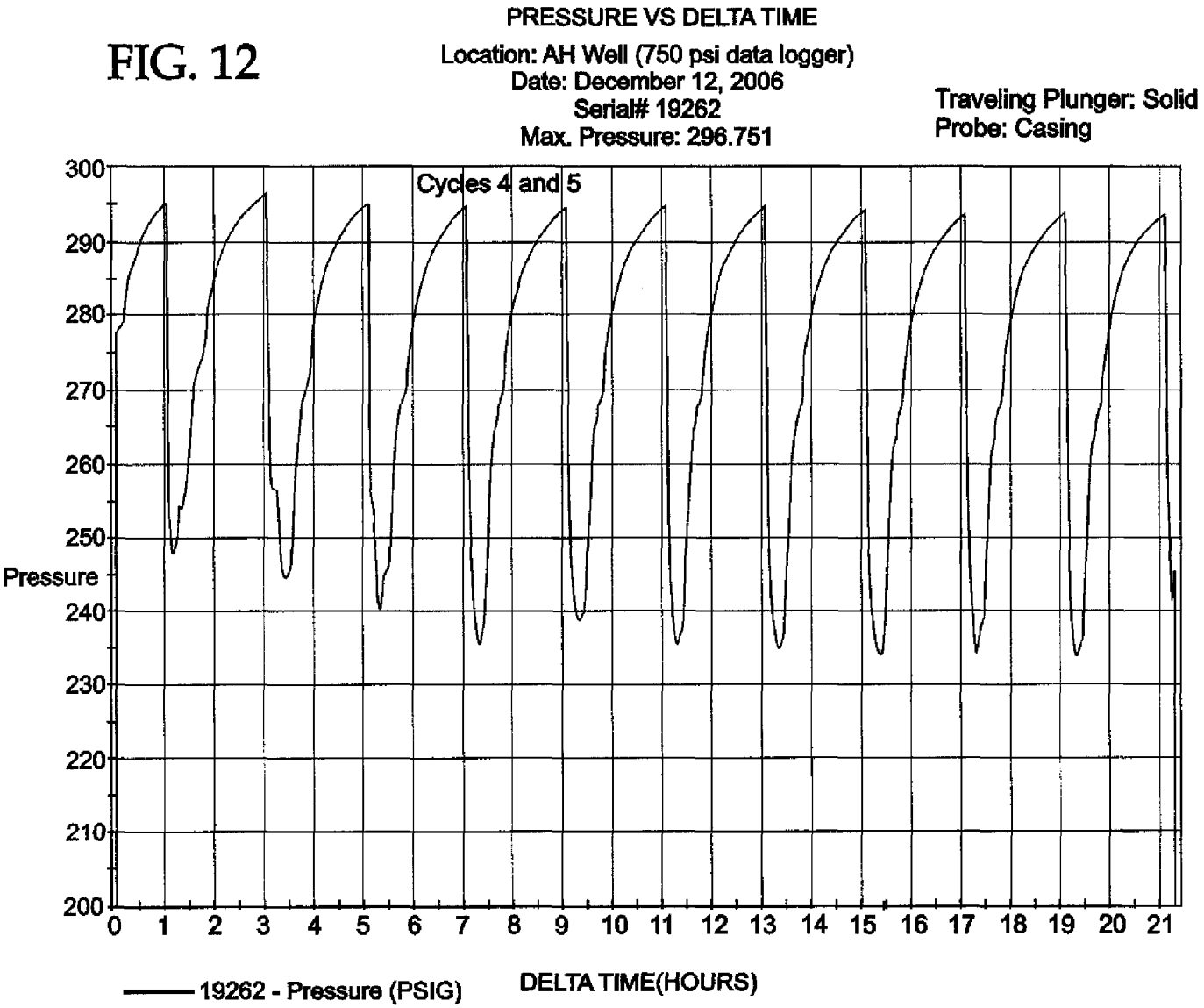
Figure 13:
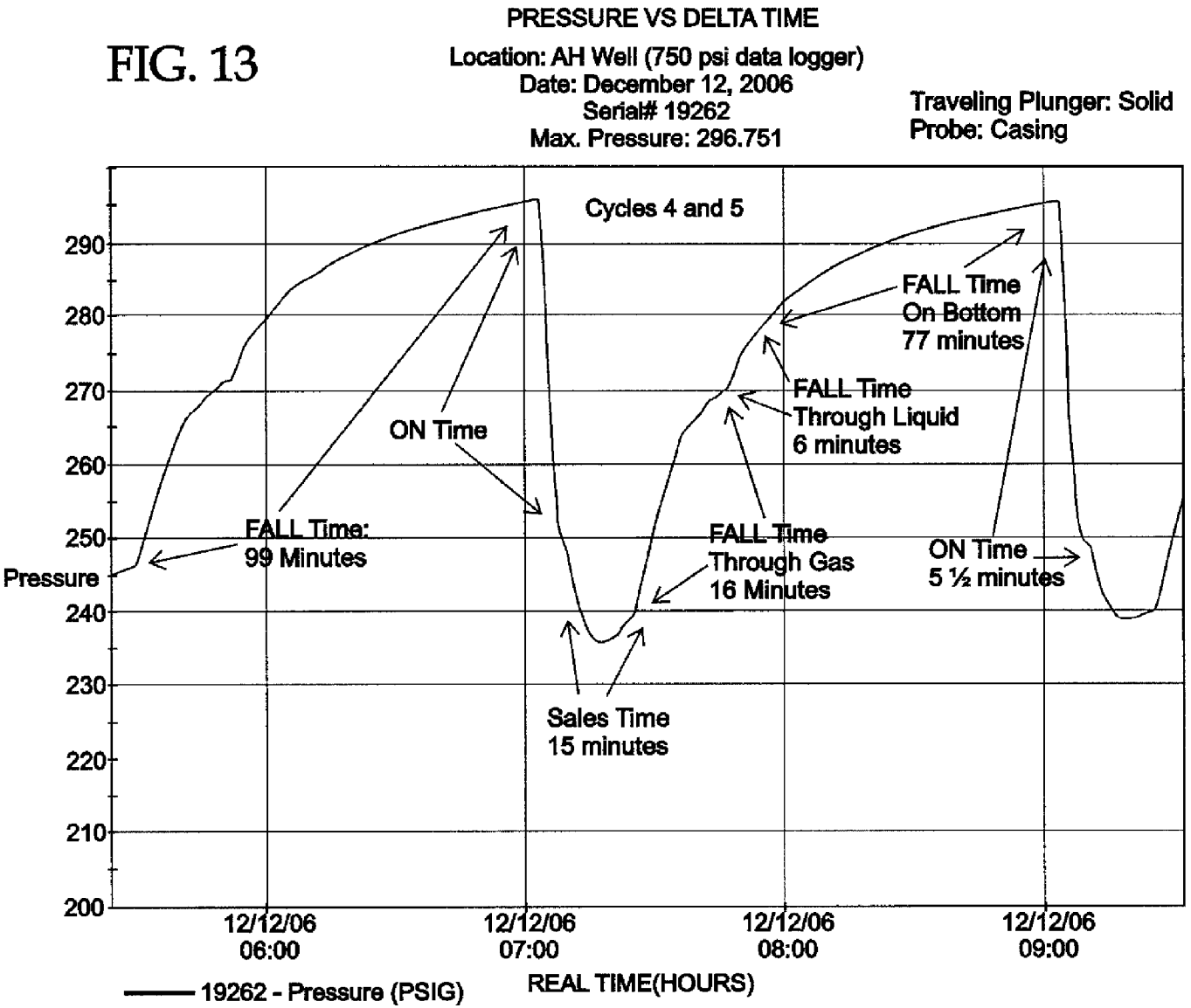
Figure 14:
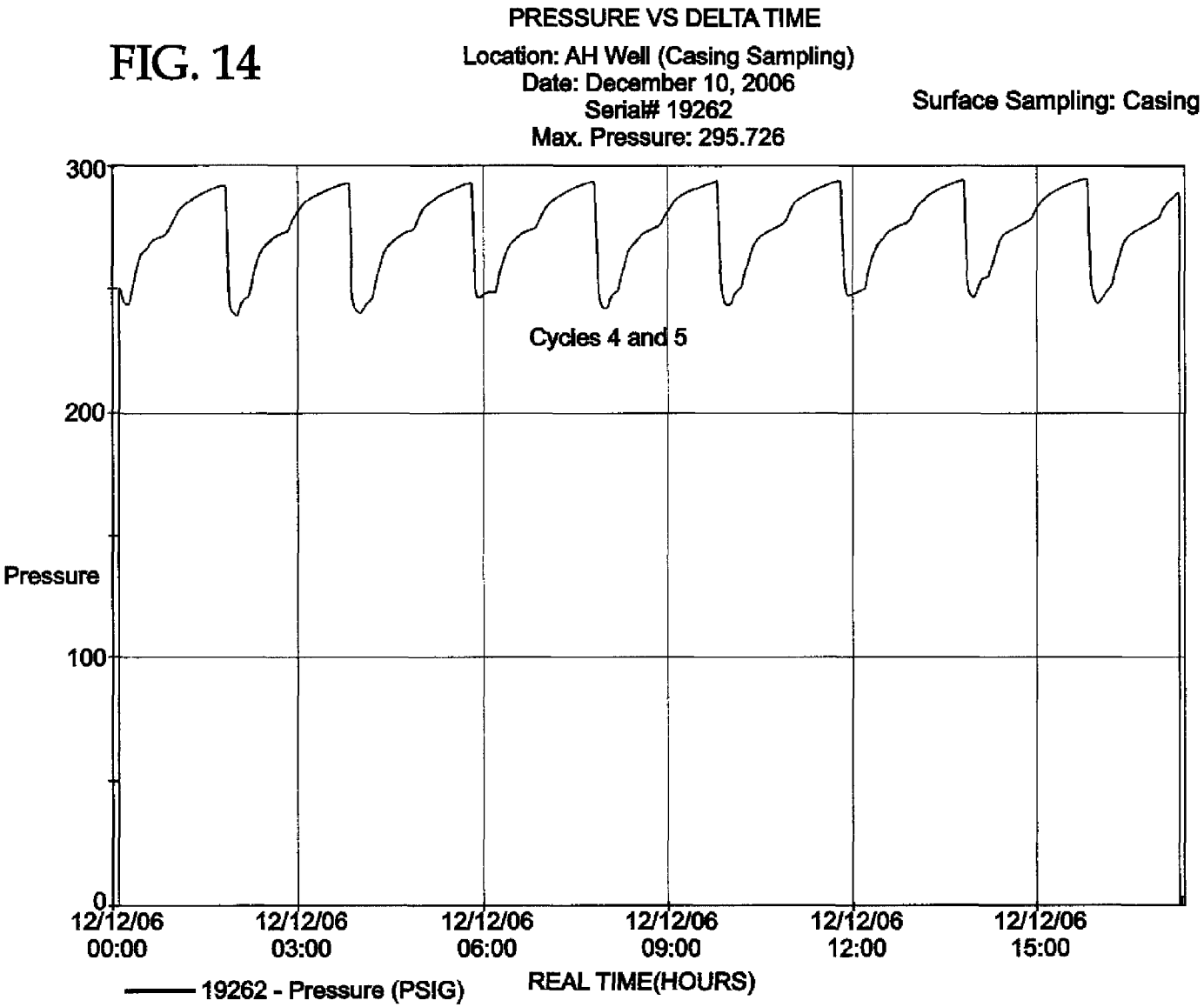
FIGS. 14-17 are graphical depictions of pressure charted versus time for a typical well utilizing a triple pad plunger in communication with a transducer mounted to a well's casing at the well surface.
Figure 15:
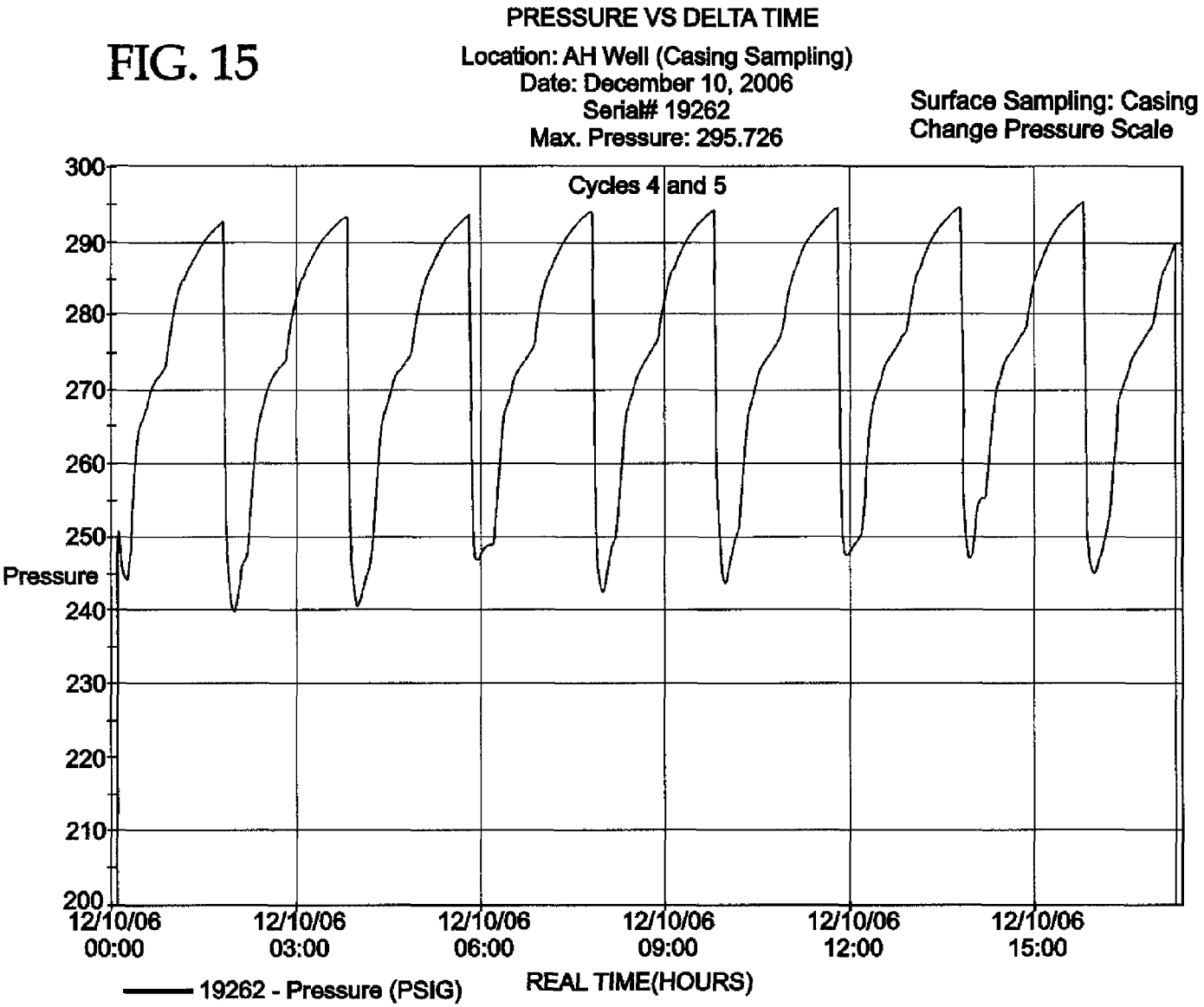
Figure 16:
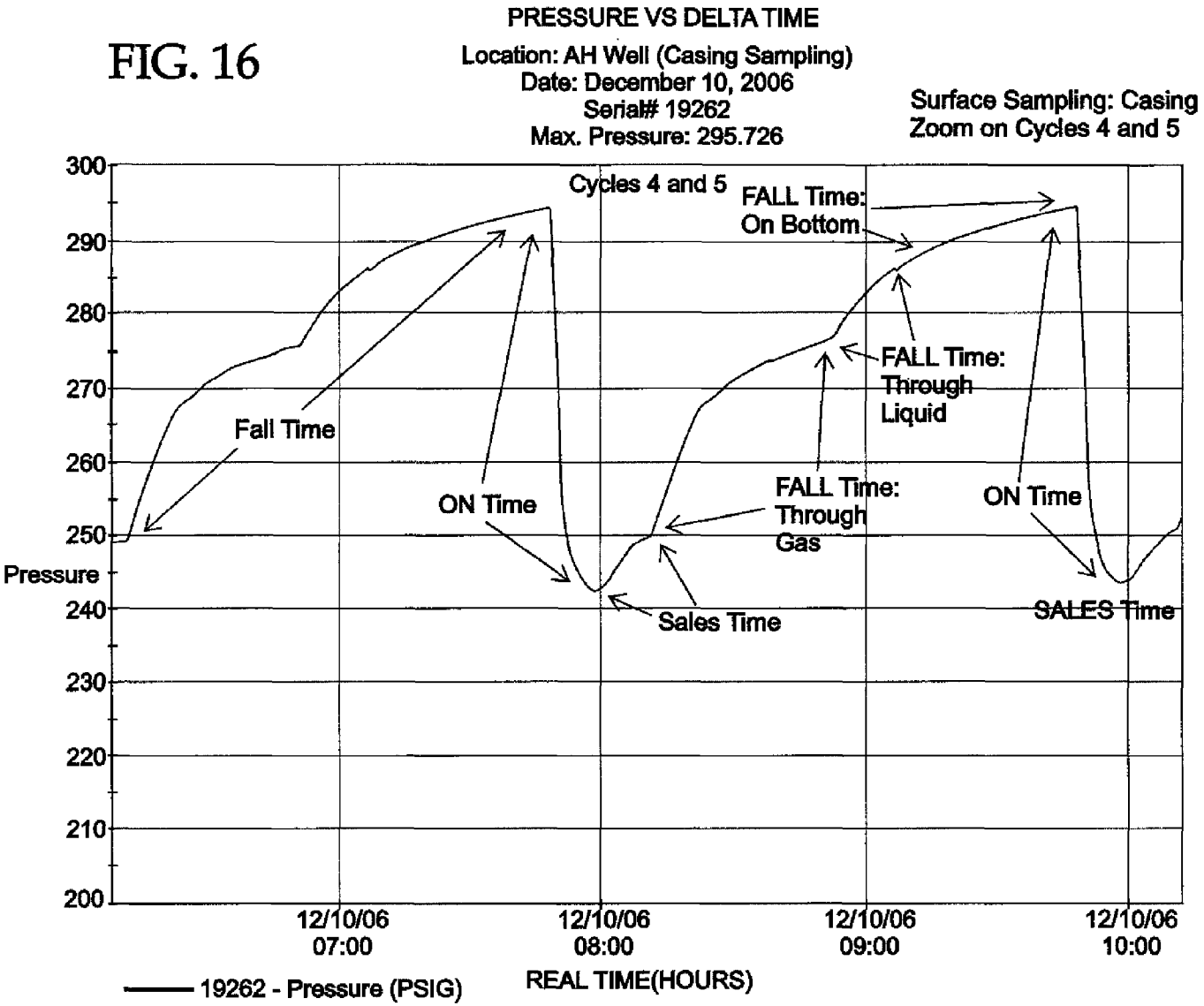
Figure 17:
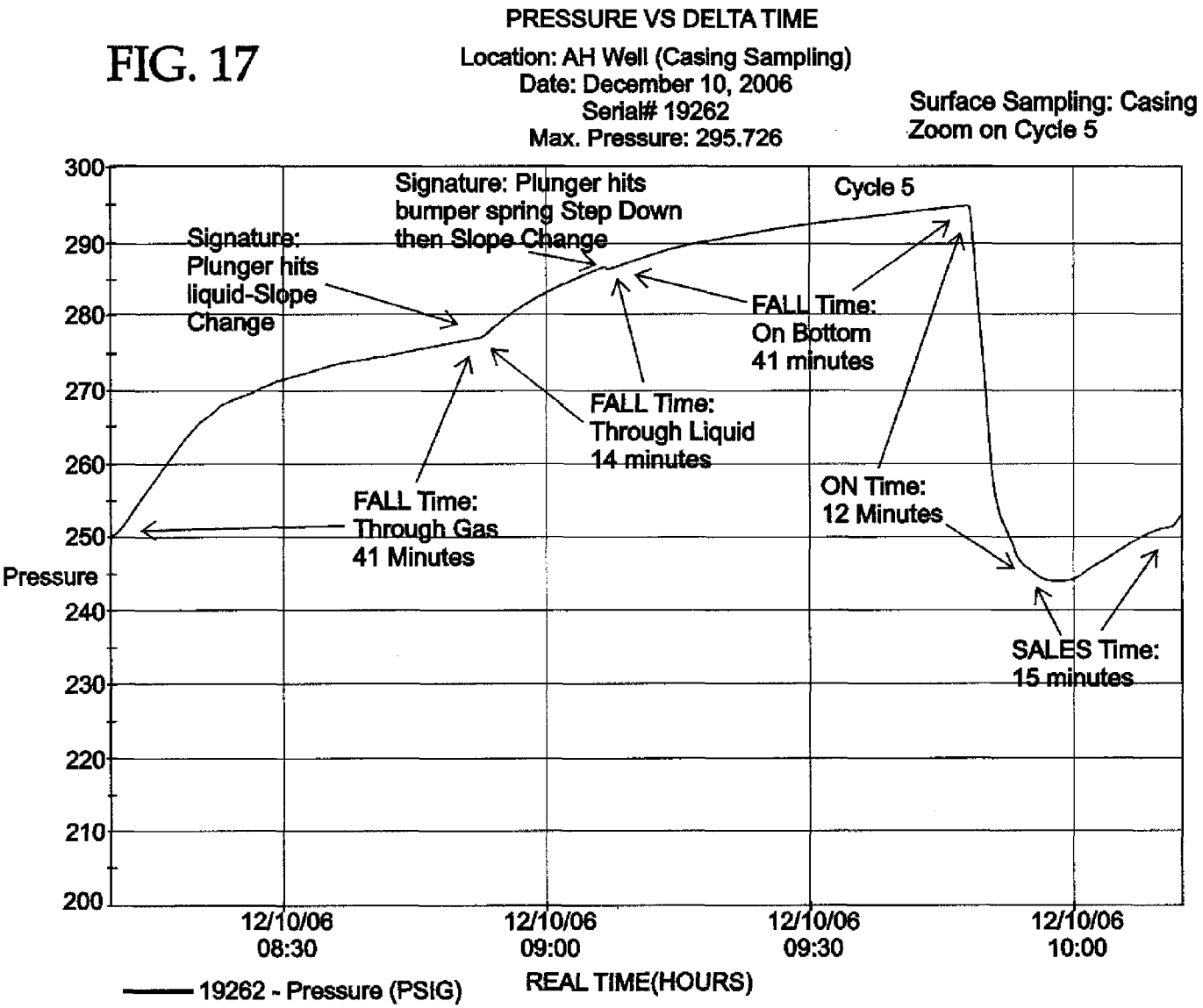

The consistency of the disclosed system can be seen in a comparison between FIGS. 1-4 and FIGS. 5-8. Although both graphs chart data for at least ten plunger cycles, no limitation is intended. In addition, the graphs chart tubing pressure data, however, casing pressure data could be used if desired. With casing pressure, the consistency of the disclosed system can be seen in a comparison between FIGS. 9-10 and FIGS. 11-13. A triple pad plunger was used to generate the data in FIGS. 1-8, and FIGS. 14-17. FIGS. 14-17 depict a test similar to that shown in FIGS. 11-13 using a different type of plunger. All tests described herein were performed in the same well.

FIG. 1 depicts a portion of a test run conducted on about Dec. 7-8, 2006 on a well employing artificial plunger lift. The graph depicts the portion of the test run occurring at about 12:00 hours to about 18:00 hours. The data was gathered by means of a plunger lift system having a computer housed therein to collect well parameter data. Applicant will refer to this plunger and computer combination as a data logger plunger. The data logger plunger can record samples taken about every one second. In this example, the graph shows data for at least ten plunger cycles and has been included to provide context for the disclosed system.

Figure 2:
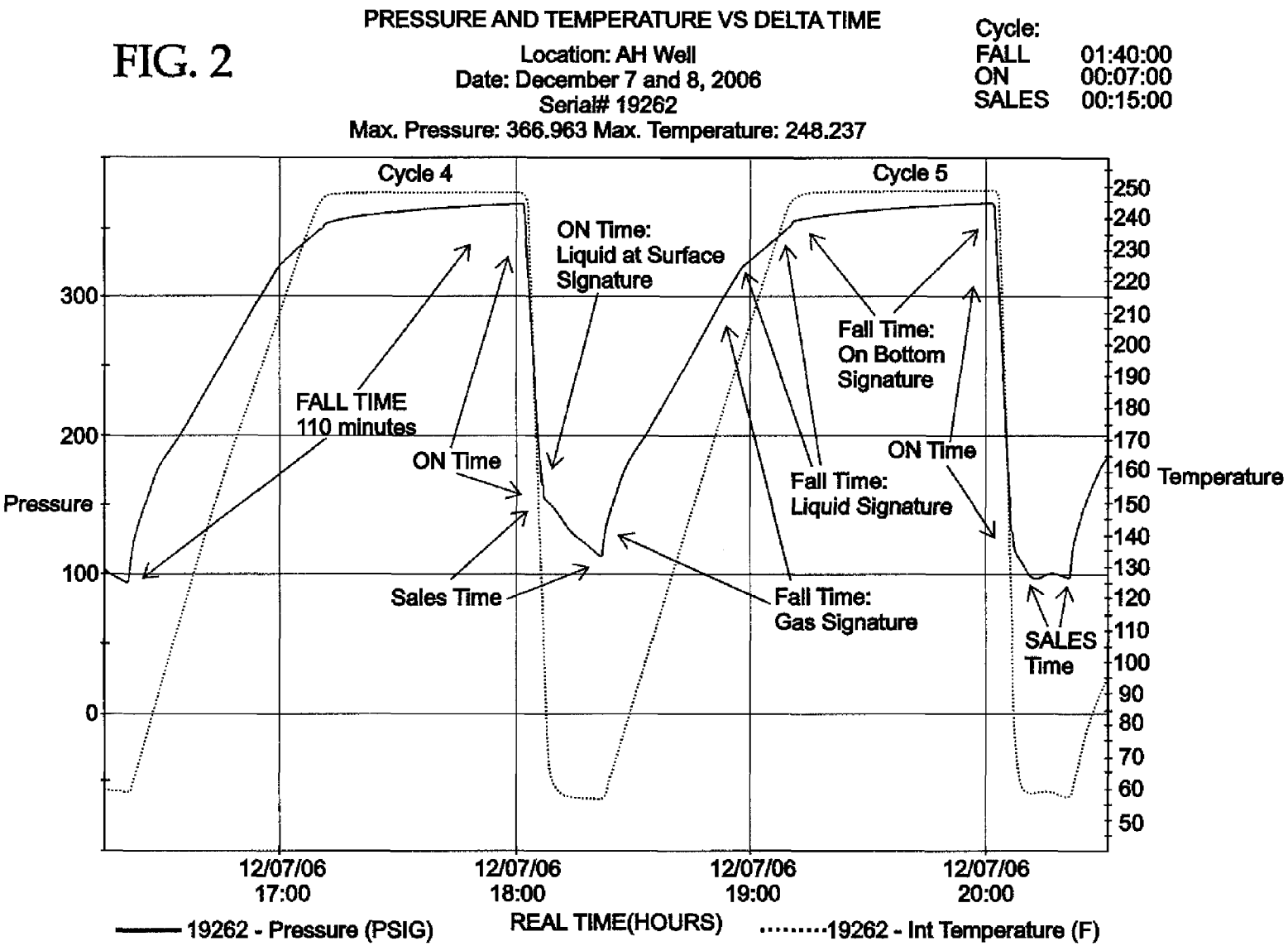
FIG. 2 is an expanded view of cycles four and five as shown in FIG. 1.

Cycles four and five of the data logger plunger test have been arbitrarily selected to illustrate various downhole occurrences and have been amplified in FIG. 2. For this test example, the well is shut in at about 16:17 hours for the cycle designated as "Cycle 4". During this shut in time, the data logger plunger cycles to the bottom of the well, traveling toward a lower bumper spring located in the bottom section of the production tubing string. During the time the well is shut in, tubing pressure can be seen to increase. In this test example, the tubing pressure has built up to about 366 psig when the well is opened. It can be confirmed that the data logger plunger is on bottom because temperature is shown in this test example to be constant at about 248° F. The plunger reaches bottom in about 59 minutes.

The well is cycled "on" shortly after about 18:00 hours. As the well is opened, the data logger plunger cycles to the surface of the well, traveling upward toward an upper bumper spring located in the surface lubricator on top of the well head. As shown on the graph, the uppermost portion of liquid carried up by the plunger is encountered at the surface at about 18:06 hours. The tubing pressure is shown to decrease. The data logger plunger arrives at the surface very shortly thereafter where it encounters a delay during which gas flow can be stabilized before the automatic controller releases the plunger, dropping it back down the tubing for the cycle to repeat. As seen on the pressure curve depicting the plunger's downhole travel, the plunger can fall through gas, through oil, and through water. As each phase transition occurs, a slope change can be encountered. As stated above, the data from the data logger plunger provides context for the disclosed system. The data logger plunger confirms that what is seen at the surface tubing and casing is what is actually happening downhole. In other words, the data logger plunger provides real-time data that can be correlated with surface tubing and casing occurrences.

After the data logger plunger hits the bottom of the well at about 19:12 hours (about 59 minutes to bottom), the plunger is shown to stay on bottom for about another 51 minutes, until shortly after about 20:03 hours when the well is opened. An operator can conclude that the plunger is on bottom since temperature is shown to be constant during the cycle. During the time the well is shut in, tubing pressure can be seen to increase. During Cycle 4, the data logger plunger recorded an off time of about 110 minutes (or about 59 minutes to reach bottom and about 51 minutes on bottom). The plunger took about seven minutes to arrive at the surface. After about 15 minutes of sales time, the well was shut in.

Figure 3:
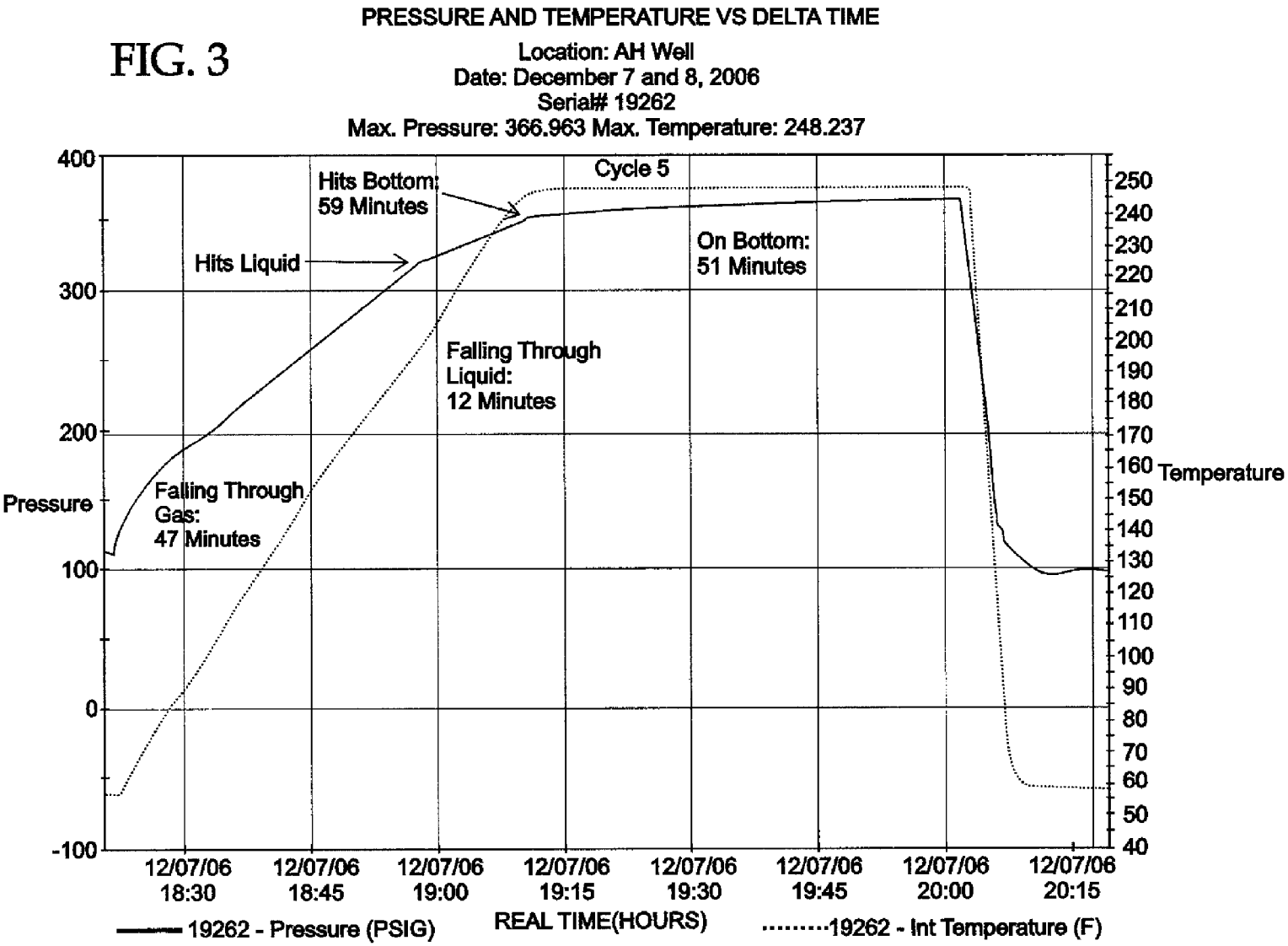
FIGS. 3, 4 are expanded views of cycle five as shown in FIGS. 1, 2.
Figure 4:
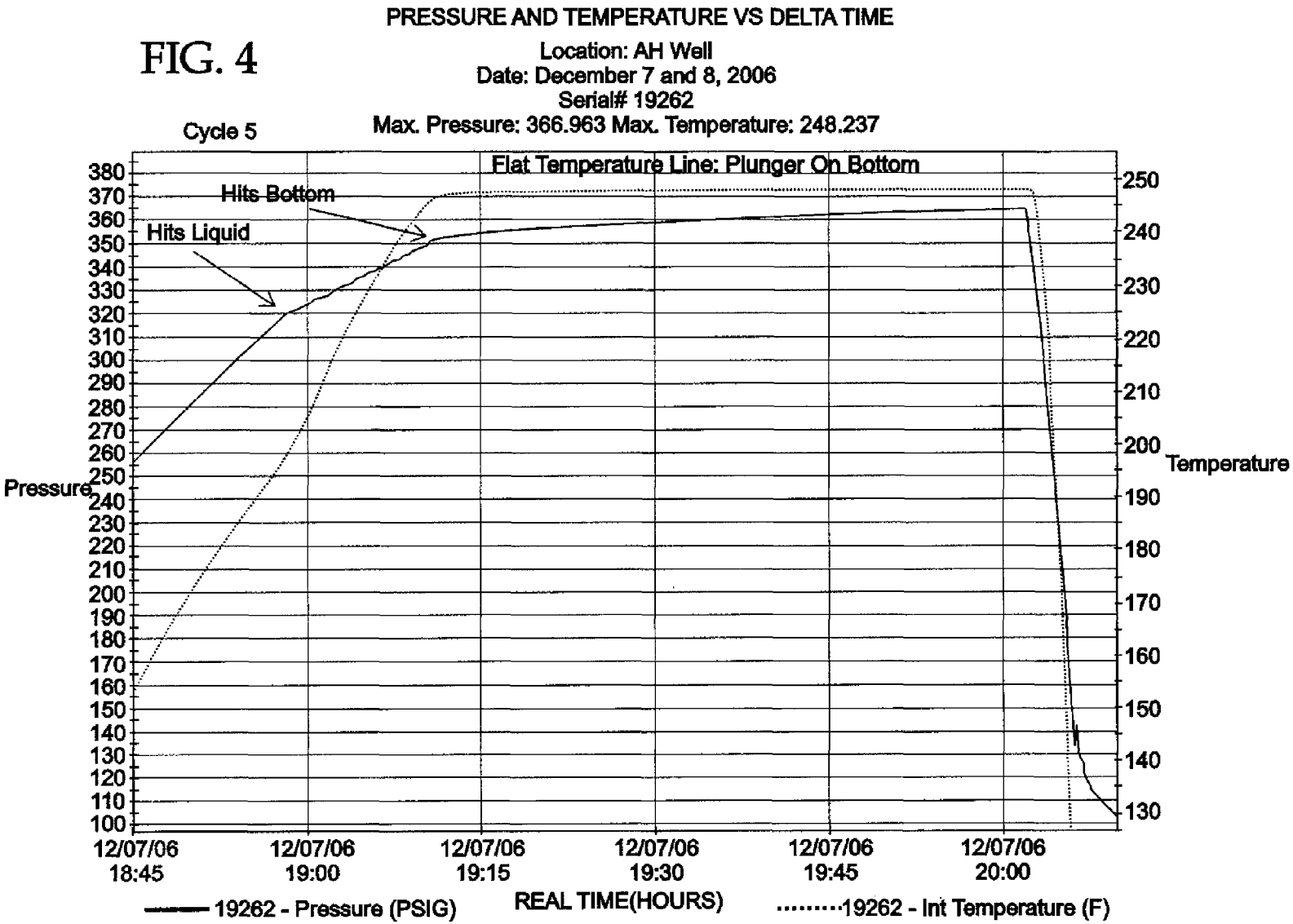

Cycle 5 is amplified in FIG. 3. The well shut in time occurs at about 18:22 hours. During this shut in time, the data logger plunger falls through gas for about a 47-minute interval. A slope change can be seen as the plunger encounters liquid. This pressure anomaly corresponds with the real-time data from the data logger which records the time at which the plunger hits liquid. After the plunger falls through liquid for about a 12-minute interval, another slope change can be seen. A third slope change is shown as the plunger hits the bottom of the well at about 19:12 hours. This pressure anomaly corresponds with the real-time data from the data logger which records the time at which the plunger hits the bottom of the well. See also FIG. 4. As stated above, an operator can conclude that the data logger plunger is on bottom since temperature readings are constant during the cycle. The present system has recorded one or more pressure anomalies while a plunger falls through liquid, akin to rough bouncing, possibly caused by gas bubbles passing through and encountering the plunger. See for example, FIG. 8, between the points when the plunger hits liquid and the plunger hits bottom.

Figure 5:
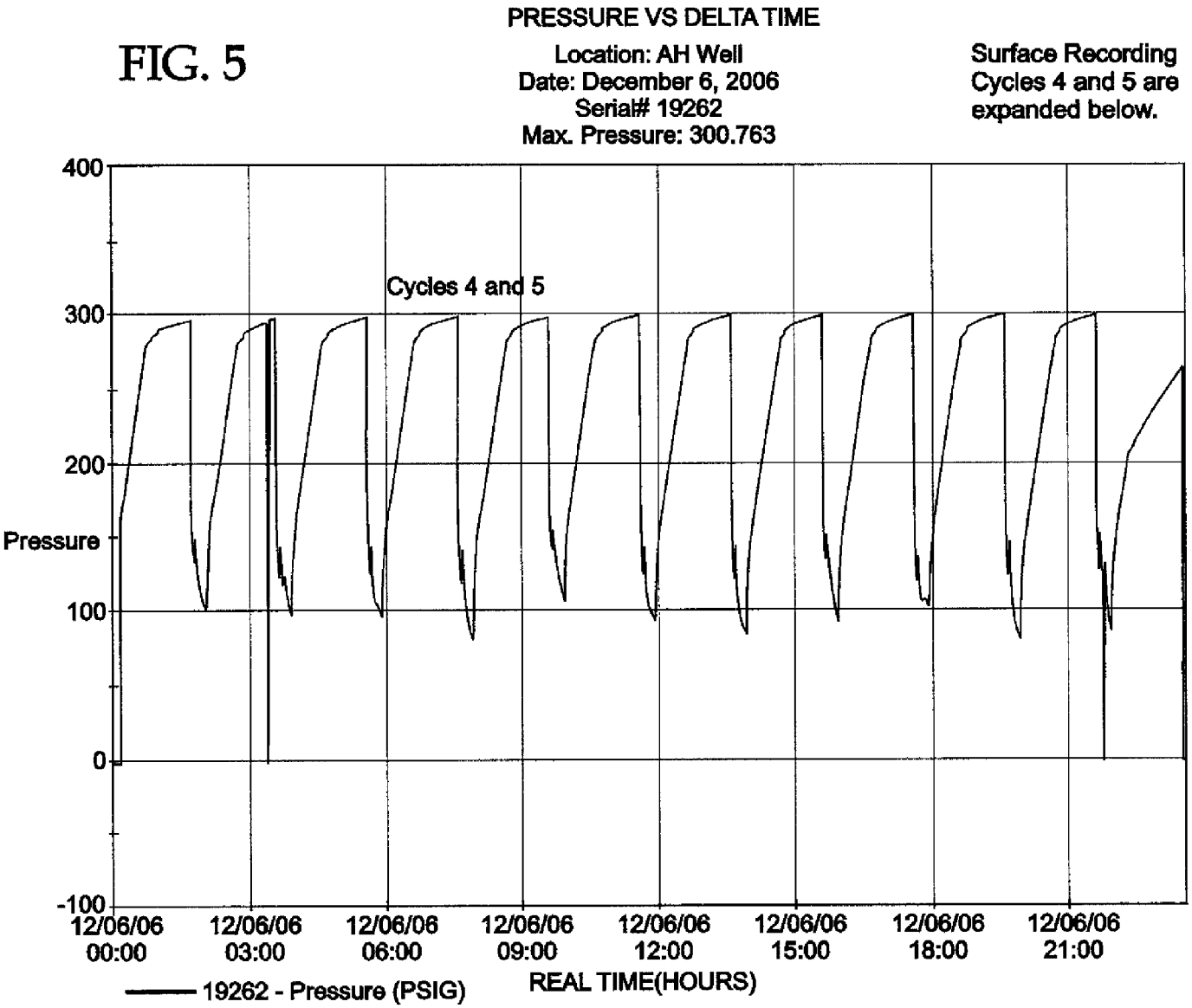
FIG. 5 is a graphical depiction of pressure charted versus time for a typical well utilizing a plunger lift system in communication with a transducer mounted to a well's tubing at the well surface. Data was taken at a rate of about one second per sample to facilitate the observation of slope changes.
Figure 6:
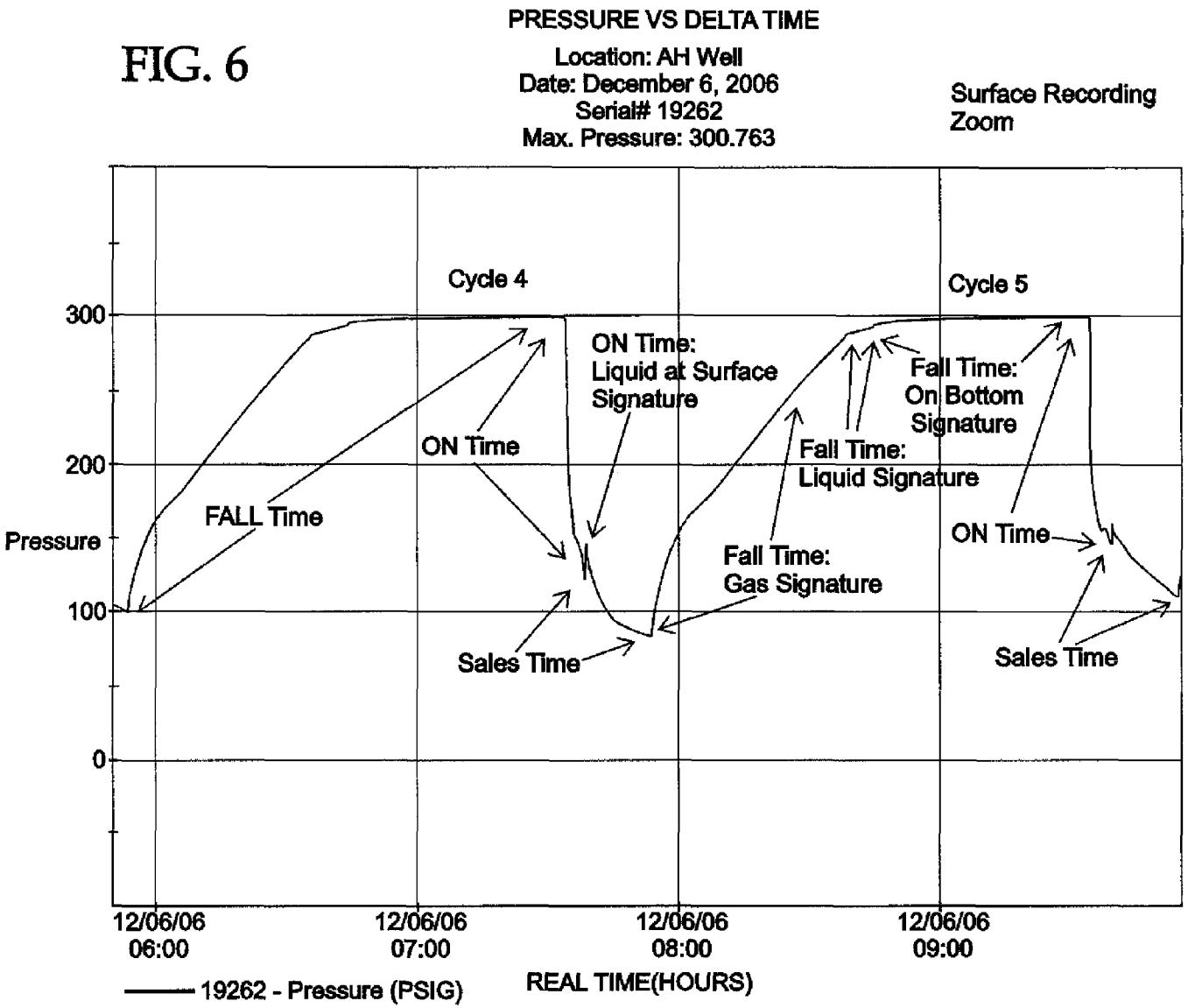
FIG. 6 is an expanded view of cycles four and five as shown in FIG. 5.
Figure 7:
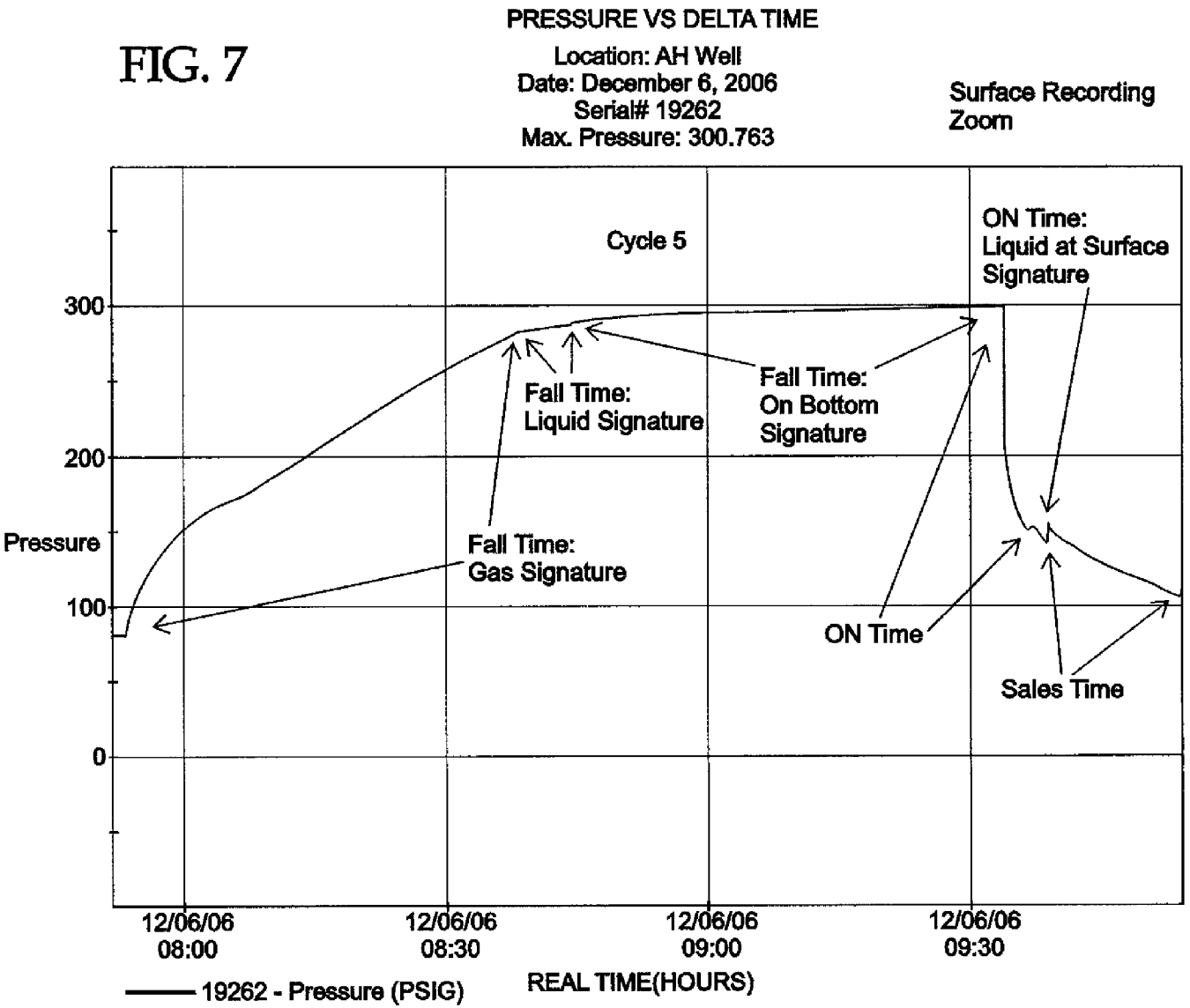
FIGS. 7, 8 are expanded views of cycle five as shown in FIGS. 5, 6.
Figure 8:
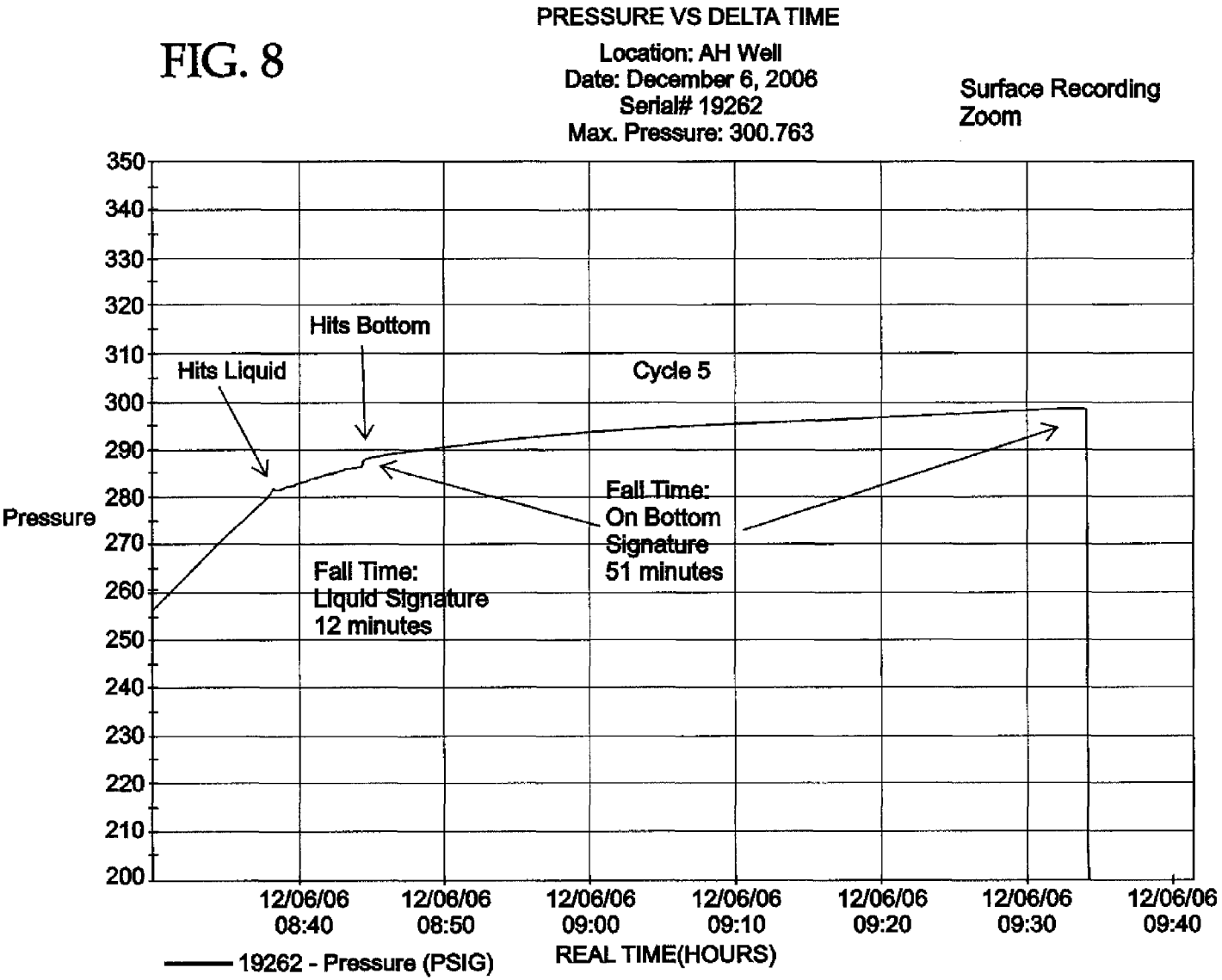
Figure 9:
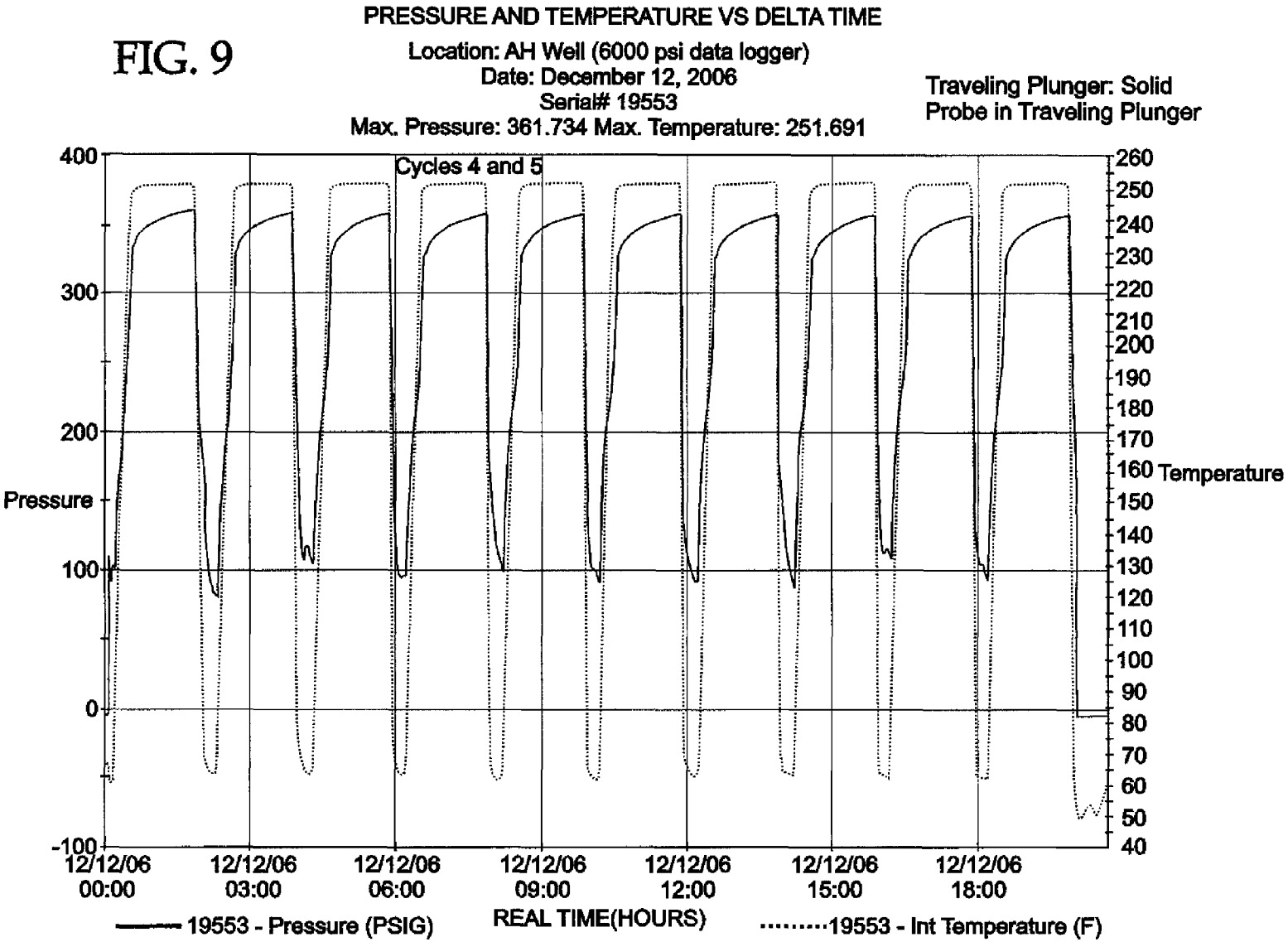
FIGS. 9, 10 are graphical depictions of pressure and temperature charted versus time for a typical well utilizing a solid plunger with a data logger computer housed therein to collect well parameter data at about a one-second sample rate.
Figure 10:
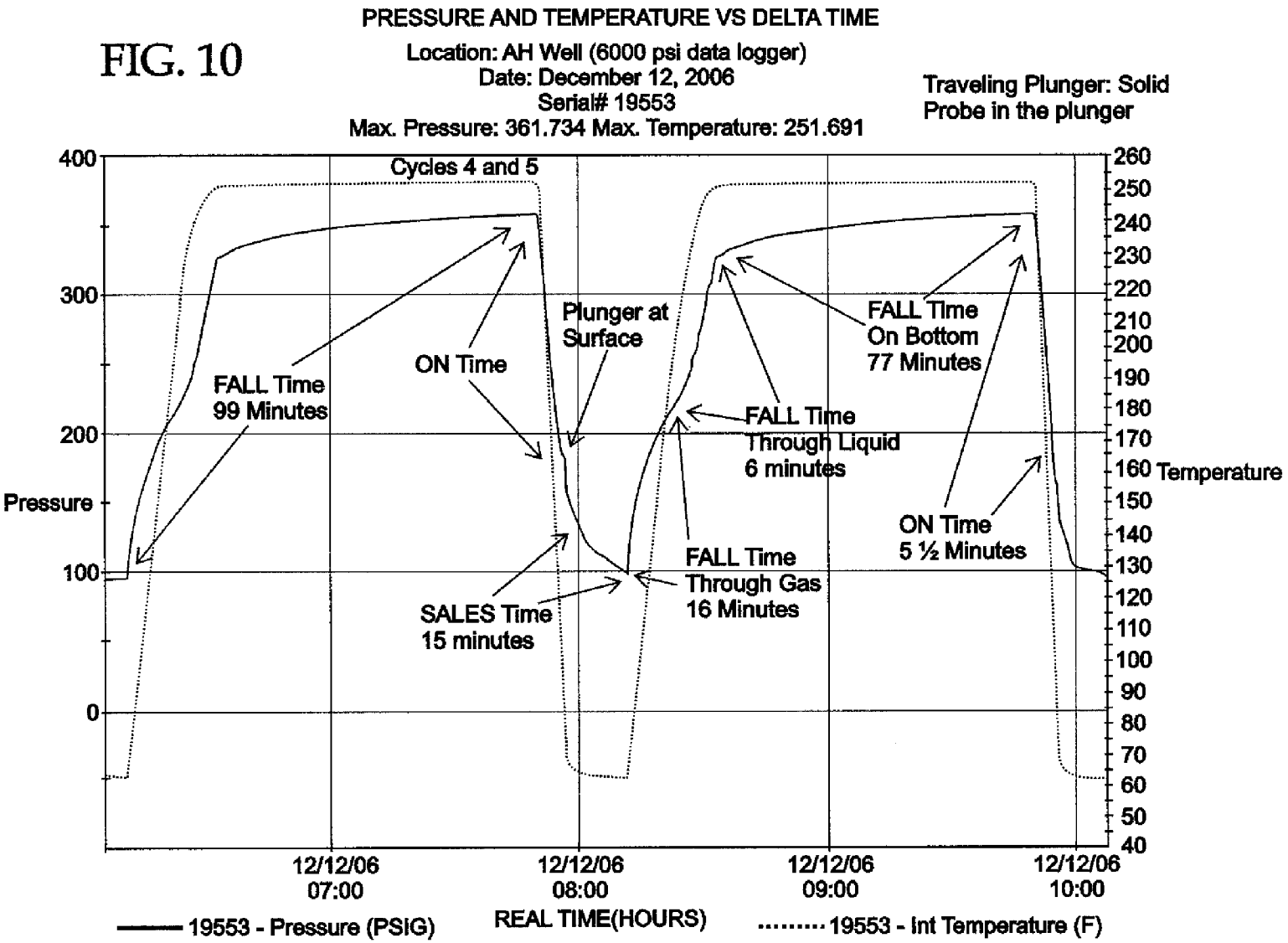

FIG. 5 depicts a portion of a test conducted on about Dec. 6, 2006 on the same well. The graph depicts the portion of the test occurring at about 00:00 hours to about 21:00 hours. The pressure data was gathered by means of a typical plunger lift system in communication with a transducer mounted to a well's tubing at the well surface. Although no data logger computer was employed during this test run, the results of the two test runs appear to be analogous. In addition, no temperature readings were recorded during this test example.

In this example, the graph shows data for at least ten plunger cycles. Cycles four and five of the test have been arbitrarily selected to illustrate various downhole occurrences and have been amplified in FIG. 6. The well is shut in at about 05:54 hours for the cycle designated as "Cycle 4". During the time the well is shut in, tubing pressure can be seen to increase. In this test example, the tubing pressure has built up to about 300 psig when the well is opened.

The well is cycled "on" shortly after about 07:35 hours. As shown on the graph, the uppermost portion of liquid carried up by the plunger is encountered at the surface at about 07:39 hours. The tubing pressure is shown to decrease. During Cycle 4, the plunger had a fall time of about 48 minutes. The shut in time is about 101 minutes. The plunger took about four minutes to arrive at the surface. After about 15 minutes of sales time, the well was shut in.

During Cycle 5, the plunger travels to well bottom, falling through gas and through liquid. Tubing pressure can again be seen to increase. As each phase transition occurs, a slope change or pressure anomaly is noted. See also FIG. 7. The well shut in time occurs at about 07:54 hours. During this shut in time, the plunger falls through gas for about a 44-minute interval. A slope change can be seen as the plunger encounters liquid. After the plunger falls through liquid for about a 12-minute interval, another slope change can be seen. See also FIG. 8. A third slope change is shown as the plunger hits the bottom of the well at about 08:44 hours. The plunger is shown to stay on bottom for about 51 minutes, until shortly after about 09:35 hours when the well is opened.

The graphs of data obtained from a data logger plunger system (FIGS. 1-4) and that from a typical plunger lift system in communication with a transducer mounted to a well's tubing at the well surface (FIGS. 5-8) appear to harmonize with each other. The two systems can produce generally very similar data. With the disclosed system, an operator can conclude that the plunger is on bottom even when temperature is not recorded because the pressure curves generated by the two systems are similar. Reviewing only the pressure curve generated by a typical plunger lift system, an operator can correlate slope changes or pressure anomalies with known plunger locations. In short, an operator can determine when the plunger is on bottom by simply looking for the appropriate slope change. If desired, a data logger system can be used to confirm a plunger's well bottom location and verify temperature and pressure patterns. However, the disclosed system presents a very simple methodology of providing well control.

The graphs of data obtained from a data logger plunger system using a solid plunger (FIGS. 9, 10) and that from a solid plunger in communication with a transducer mounted to a well's casing at the well surface (FIGS. 11-13) appear to harmonize with each other. As stated above, an operator can conclude that the plunger is on bottom even when temperature is not recorded because the pressure curves generated by the two systems are similar. Reviewing only the casing pressure curve generated by a typical plunger lift system, an operator can correlate slope changes or pressure anomalies with known plunger locations. With casing pressure, however, the slope is shown to curve down.

The graphs of data obtained from a typical triple pad plunger lift system in communication with a transducer mounted to the well's casing at the well surface are shown in FIGS. 14-17. In similar fashion with the description above, an operator can determine when the plunger is on bottom by simply looking for the appropriate slope change in the casing pressure curve.

Figure 18:
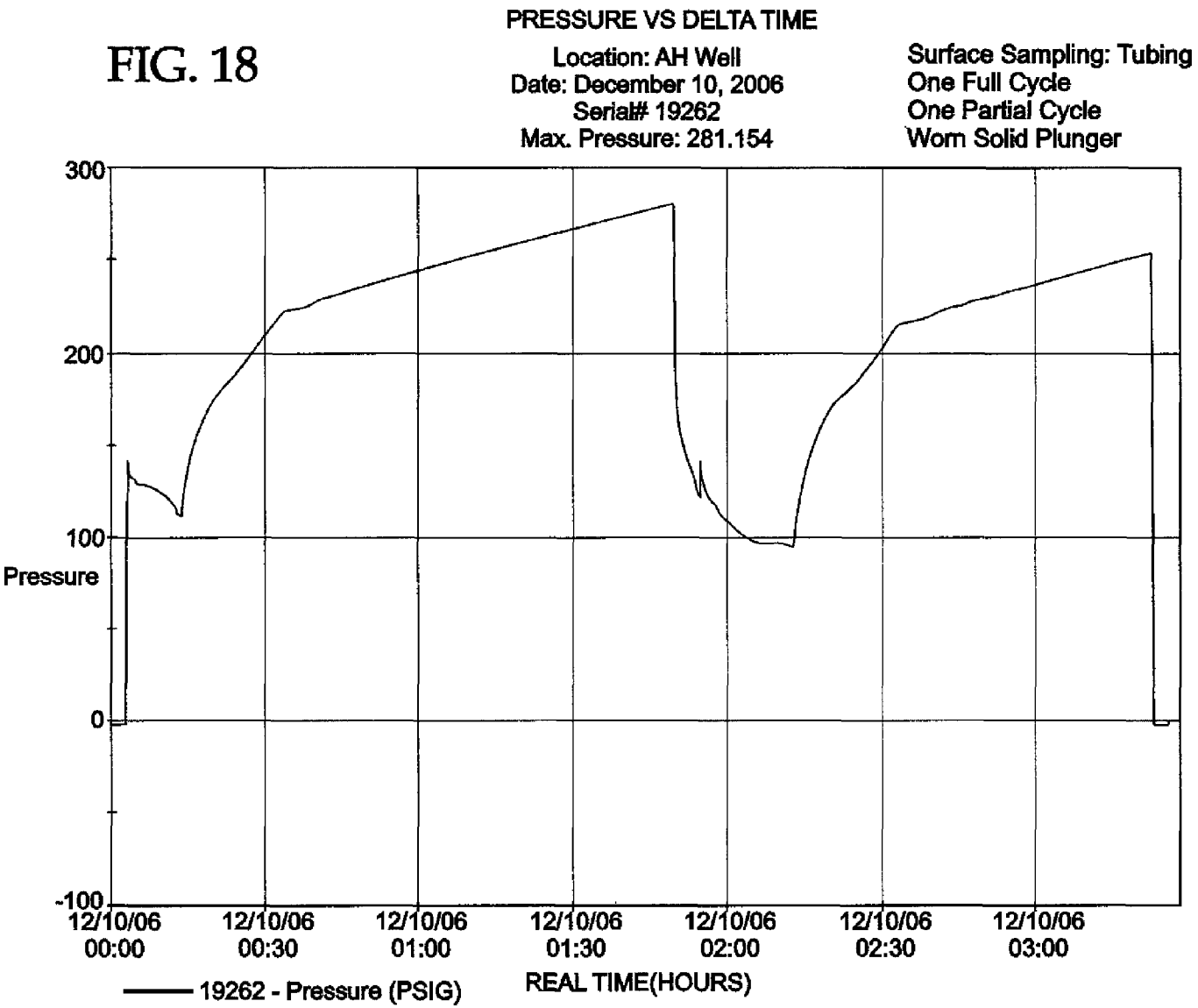
FIGS. 18-20 are graphical depictions of pressure charted versus time for a typical well utilizing a worn solid plunger in communication with a data logger mounted to a well's tubing at the well surface.
Figure 19:
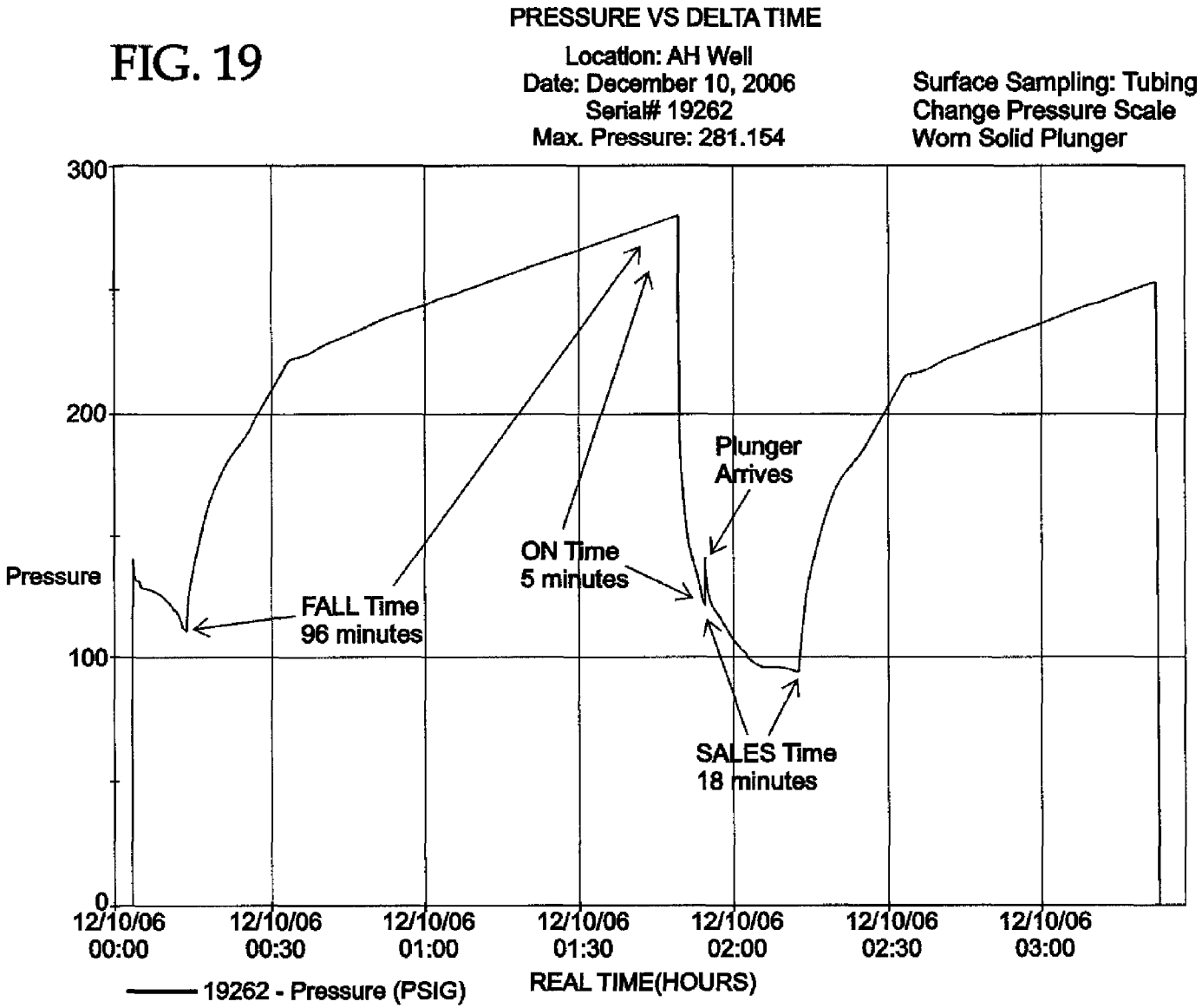
Figure 20:
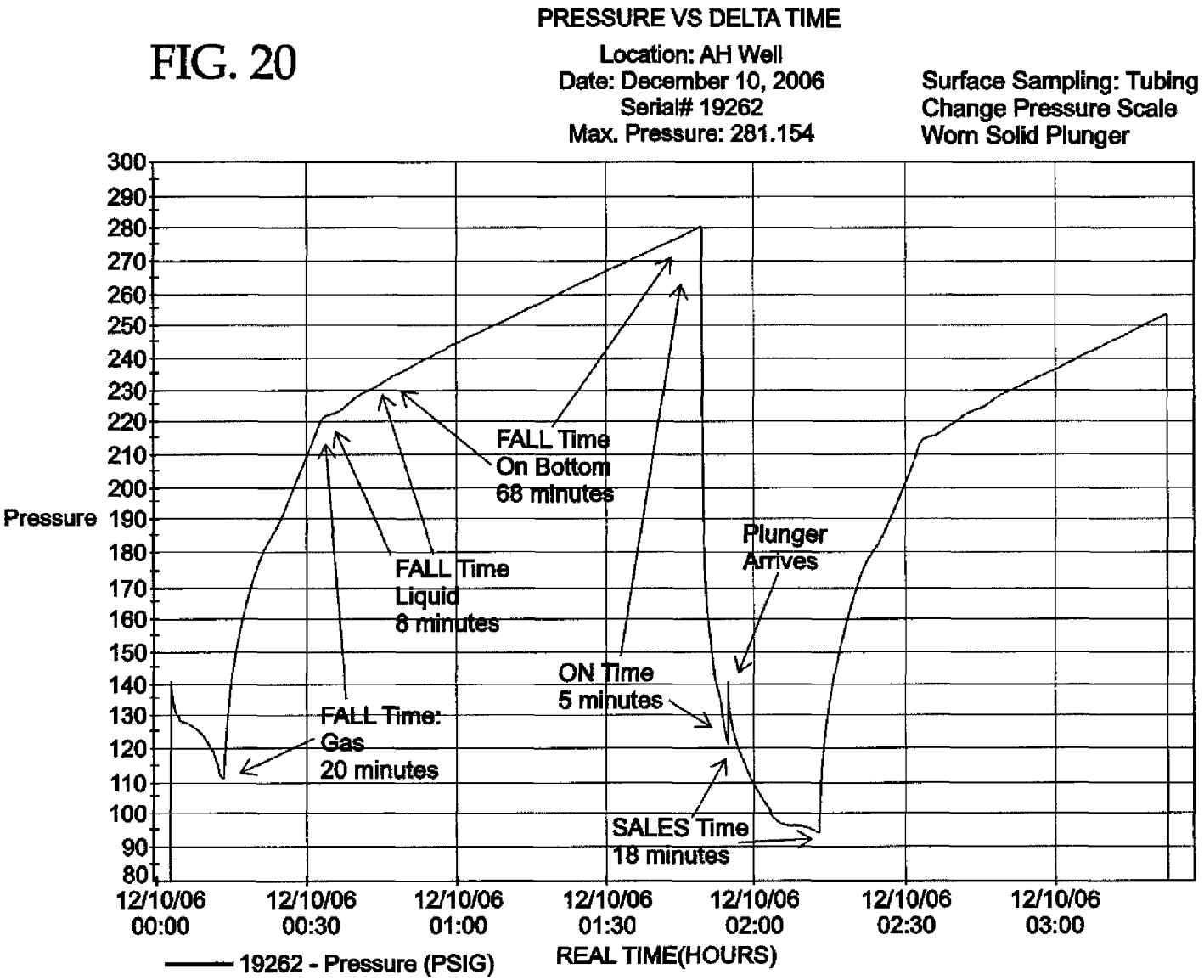

Tests performed with a well-sealed plunger produced sharper pressure curves than tests performed with more worn plungers. In other words, the degree of the slope change can provide notification that a plunger is worn and/or is no longer making a good seal. Therefore, the disclosed system could also be used to indicate when a plunger should be serviced, replaced, etc. As shown in FIGS. 18-20, one plunger cycle is amplified. The test was performed in the same well on Dec. 10, 2006. At about 13:55, the well shuts in. The plunger fall time for a solid plunger is about 28 minutes. The shut in time is about 96 minutes. The plunger arrives at surface in about 5 minutes. During the fall time, the plunger can be seen passing through gas (about 20 minutes) and liquid (about 8 minutes). The plunger is on bottom for about 68 minutes. On FIG. 20, the slope of the curve as the plunger passes through liquid and when it hits bottom is less acute. For comparison, see FIGS. 3, 7. In similar fashion, the disclosed system could be used to indicate if service to a well's tubing and/or casing is appropriate. By looking closely at trends in the data made available by the present system, it has been discovered that the disclosed system can offer deductive clues as to what is happening downhole and/or with well production. Thus, the present system can provide a user with a way to review data and/or well events to base well production decisions thereon. These anomalies and/or well events can be indicators that may be used other than to determine when a plunger is on bottom. Reviewing the data can help users make pertinent decisions to more efficiently produce the well.

In the case of the data logger plunger and the plunger of the disclosed device, the plungers travel downhole through gas. The respective gas signature curves can be seen to be increasing near linearly as each type of plunger approaches liquid. As each plunger encounters liquid, an acute slope can be seen. The respective liquid signature curves can be seen to be increasing near linearly until each plunger hits the bottom, after which the slopes grow less acutely until each appears to flatten out.

It is believed that the pressure anomalies may be attributed to a collapse of the pressure wave above a plunger. A pressure wave develops as a plunger descends downhole, pulling a relative vacuum above the plunger and compressing gas below the plunger. When the plunger stops at the bottom of the tubing string (or as the plunger enters liquid), the vacuum wave above the plunger exerts a force over the now-stopped (or slowed plunger), which reflects back and travels back up the tubing string as a compressive wave. The compressive wave reflected uphole can be measured at the surface as pressure anomalies.

The plunger's on bottom location can be verified by any known means. For example, a sophisticated data logger plunger as described above can be used. In addition, echometers and other acoustic liquid level instruments, microphone and gas gun assemblies, accelerometers, etc. could also be employed to confirm plunger location.

As stated above, the graphical depictions of well data used herein are for illustrative purposes only. The present system is capable of interpreting pressure data and may not require a graphical depiction. The present system can be utilized with wired and/or wireless applications.

While a number of exemplifying features and embodiments have been discussed above, those of skill in the art will recognize certain modifications, permutations, additions and subcombinations thereof. Other alternate embodiments of the present apparatus could easily be employed by those skilled in the art to achieve the functions of the present apparatus and methodology. It is to be understood that additions, deletions, and changes may be made to the system and various internal and external functions disclosed herein, and still fall within the true spirit and scope of the disclosure. No limitation with respect to the specific embodiments disclosed herein is intended or should be inferred.

I claim:

1. A method of controlling a well by solely utilizing pressure anomalies, the method comprising the steps of:

providing a well controller to monitor at least one of tubing and casing pressure in a well utilizing a plunger;

allowing the controller to correlate a pressure anomaly with a target or plunger "on-bottom" location; and releasing the well to open when the pressure anomaly indicates the plunger is at the target or "on-bottom" location.

2. The method of claim 1 further comprising the step of allowing the controller to confirm the fall time/rate corresponds with the plunger's target or "on-bottom" location.

3. The method of claim 2, wherein the confirmation step further comprises using an average fall time/rate from a predetermined number of runs.

4. The method of claim 3, wherein said averaged fall time/rate is compared to the fall time/rate from a previous number of runs.

5. The method of claim 1 further comprising the step of allowing the controller to correlate a pressure anomaly with a plunger-fluid interface.

6. The method of claim 1 further comprising the step of allowing the controller to correlate a pressure anomaly with a plunger's fall through gas or liquid.

7. The method of claim 1, wherein pressure anomalies can vary with each type of plunger.

8. The method of claim 1, wherein a variance in the pressure anomaly can indicate the condition or wearing of said plunger.

9. The method of claim 1 further comprising the step of allowing the controller to determine a plunger fall time/rate for said well based on said plunger's target or "on-bottom" location.

10. The method of claim 1, wherein the releasing step further comprises maintaining the well in a shut-in/safety mode if the controller determines the plunger is not at the target or "on-bottom" location.

11. The system of claim 1, wherein the pressure anomaly can be attributed to a collapse of the pressure wave above a plunger.

12. A method of automatically controlling and operating one or more hydrocarbon production wells by utilizing a pressure signature solely in conjunction with a plunger's fall time as an indicator of plunger location in a well, said method comprising:

placing said plunger in a tubing of said well, said plunger capable of traveling to a bottom of said well;

obtaining at least one of tubing and/casing pressure data associated with said well;

correlating said pressure data with an established plunger fall time or on bottom location; and confirming said plunger is on bottom before opening a flowline to enable said plunger to flow upward along with liquids in the tubing even if other production parameters signal that said flowline should be opened, thereby maintaining the well in a shut-in/safety mode.

13. The method of claim 12, wherein said correlation step further comprises interpreting said pressure data for an occurrence of one or more pressure signatures or anomalies.

14. The method of claim 13 further comprising the step of determining tubing, casing and/or plunger conditions from the degree of variance in said one or more pressure signatures or anomalies.

15. The method of claim 12 further comprising the step of re-establishing plunger fall time as well conditions change.

16. The method of claim 12 further comprising the step of utilizing a data logging plunger capable of providing real-time data to verify that said plunger is on bottom.

17. A system of well control that solely utilizes pressure anomalies, the system comprising:

a well controller to monitor at least one of tubing and casing pressure in a well utilizing a plunger;

wherein the controller correlate a pressure anomaly with a target or plunger "on-bottom" location; and wherein the controller releases the well to open when the pressure anomaly indicates the plunger is at the target or "on-bottom" location.

18. A system for controlling the shut in time of a hydrocarbon production well by solely utilizing pressure anomalies, the system comprising:

a pressure transducer for obtaining at least one of well tubing and casing pressure data as a plunger travels to a bottom of said well;

a well controller to monitor the at least one of tubing and casing pressure and to detect a slope change or pressure signature/anomaly in the pressure data; and the controller capable of determining a plunger fall time or correlating a plunger location from the slope change or pressure signature/anomaly for one or more number of runs, the controller further being capable of using an average of plunger fall times to determine if the well should be opened or remain shut-in, even if other production parameters signal that the well should be opened.

19. The system of claim 18, wherein the controller can compare the averaged fall time to the fall time from a previous number of runs to adjust shut in time.

20. The system of claim 18, wherein the slope change or pressure signature/anomaly can correspond with the plunger's well bottom location.

21. The system of claims 18, wherein the slope change or pressure signature/anomaly can correspond with the plunger's contact with fluid or with the plunger's travel through fluid.

22. The system of claim 18 further comprising a verification system capable of providing real-time data to confirm said plunger's location.

23. The system of claim 18, wherein the slope change or pressure signature/anomaly can indicate well and/or plunger conditions.

24. The system of claim 18, wherein the slope change or pressure signature/anomaly can vary as a function of plunger type.

* * * * *